US008002087B2

(12) United States Patent
Takahashi

(10) Patent No.: US 8,002,087 B2
(45) Date of Patent: Aug. 23, 2011

(54) ENTRANCE/EXIT DEVICE FOR ELEVATOR

(75) Inventor: Makoto Takahashi, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 719 days.

(21) Appl. No.: 11/579,739

(22) PCT Filed: Mar. 18, 2005

(86) PCT No.: PCT/JP2005/004941

§ 371 (c)(1),
(2), (4) Date: Nov. 7, 2006

(87) PCT Pub. No.: WO2006/100717

PCT Pub. Date: Sep. 28, 2006

(65) Prior Publication Data

US 2007/0227824 A1 Oct. 4, 2007

(51) Int. Cl.
*B66B 13/26* (2006.01)

(52) U.S. Cl. ..... 187/317; 187/247; 187/316

(58) Field of Classification Search ..... 187/247, 187/316, 317, 380

See application file for complete search history.

(56) References Cited

U.S. PATENT DOCUMENTS

| | | | | | |
|---|---|---|---|---|---|
| 4,560,912 | A * | 12/1985 | Jonsson | 318/480 |
| 4,673,911 | A * | 6/1987 | Yoshida | 187/380 |
| 4,979,594 | A * | 12/1990 | Begle et al. | 187/380 |
| 5,004,076 | A * | 4/1991 | Chen et al. | 187/391 |
| 5,284,225 | A * | 2/1994 | Platt | 187/316 |
| 5,736,692 | A * | 4/1998 | Lumme et al. | 187/247 |
| 5,932,853 | A * | 8/1999 | Friedli et al. | 187/392 |
| 6,152,265 | A * | 11/2000 | Bittar et al. | 187/384 |
| 6,202,799 | B1 * | 3/2001 | Drop | 187/388 |
| 6,828,918 | B2 * | 12/2004 | Bowman et al. | 340/825.19 |
| 7,079,669 | B2 * | 7/2006 | Hashimoto et al. | 382/118 |
| 7,377,364 | B2 * | 5/2008 | Tyni et al. | 187/380 |
| 2001/0002644 | A1 * | 6/2001 | Haruta et al. | 198/322 |
| 2005/0133701 | A1 * | 6/2005 | Anderson, II | 250/221 |
| 2005/0252622 | A1 * | 11/2005 | Reid | 160/180 |
| 2006/0186993 | A1 * | 8/2006 | Inoue | 340/5.72 |
| 2007/0046460 | A1 * | 3/2007 | Aljadeff et al. | 340/539.13 |
| 2008/0264730 | A1 * | 10/2008 | Blackaby et al. | 187/380 |
| 2009/0236185 | A1 * | 9/2009 | Yumura et al. | 187/317 |

FOREIGN PATENT DOCUMENTS

| | | | |
|---|---|---|---|
| DE | 03330345 | * | 3/1985 |
| JP | 62 21688 | | 1/1987 |
| JP | 2 255487 | | 10/1990 |
| JP | 04213587 A | * | 8/1992 |
| JP | 9 86841 | | 3/1997 |
| JP | 9 255266 | | 9/1997 |
| JP | 10 87242 | | 4/1998 |
| JP | 10 109843 | | 4/1998 |
| JP | 11 106168 | | 4/1999 |
| JP | 2002 167128 | | 6/2002 |
| JP | 2003 48671 | | 2/2003 |
| JP | 2004 10303 | | 1/2004 |
| JP | 2005 35737 | | 2/2005 |
| JP | 2006027839 A | * | 2/2006 |

* cited by examiner

*Primary Examiner* — Walter Benson
*Assistant Examiner* — Kawing Chan
(74) *Attorney, Agent, or Firm* — Oblon, Spivak, McClelland, Maier & Neustadt, L.L.P.

(57) ABSTRACT

An elevator entrance apparatus includes a reading device for reading transmission information from a transmission device, and a control device for controlling operation of an elevator based on information as to whether transmission information has been read by the reading device or not. The reading device reads transmission information only when the transmission device is within a predetermined detection range on an inner side of an elevator entrance.

19 Claims, 11 Drawing Sheets

ENTRANCE/EXIT DEVICE FOR ELEVATOR

TECHNICAL FIELD

The present invention relates to an elevator entrance apparatus for detecting a passenger at an elevator entrance.

BACKGROUND ART

Conventionally, to detect a passenger in an elevator more reliably, there has been proposed a passenger detecting device for an elevator, which detects a passenger by means of a camera installed in a landing. According to this conventional passenger detecting device for an elevator, an image taken by the camera is processed to make a judgment as to whether the passenger is a person in normal health or a physically handicapped person. This makes it possible to operate the elevator in different ways respectively suitable for a person in normal health and a physically handicapped person (see Patent Document 1).

Patent Document 1: JP 2004-10303 A

DISCLOSURE OF THE INVENTION

Problem to be Solved by the Invention

However, such a conventional passenger detecting device for an elevator involves a camera, an image processing apparatus, etc., which are rather expensive, resulting in a high equipment introduction cost.

The present invention has been made with a view toward solving the above problem. It is an object of the present invention to provide an elevator entrance apparatus which can more reliably detect a passenger at an elevator entrance and which helps to achieve a reduction in cost.

Means for Solving the Problems

An elevator entrance apparatus according to the present invention includes: a reading device for reading transmission information from a transmission device only when the transmission device is within a predetermined detection range on an inner side of an elevator entrance; and a control device for controlling an operation of an elevator based on information as to whether the transmission information has been read by the reading device or not.

BEST MODE FOR CARRYING OUT THE INVENTION

In the following, preferred embodiments of the present invention will be described with reference to the drawings.

Embodiment 1

Figure 1:
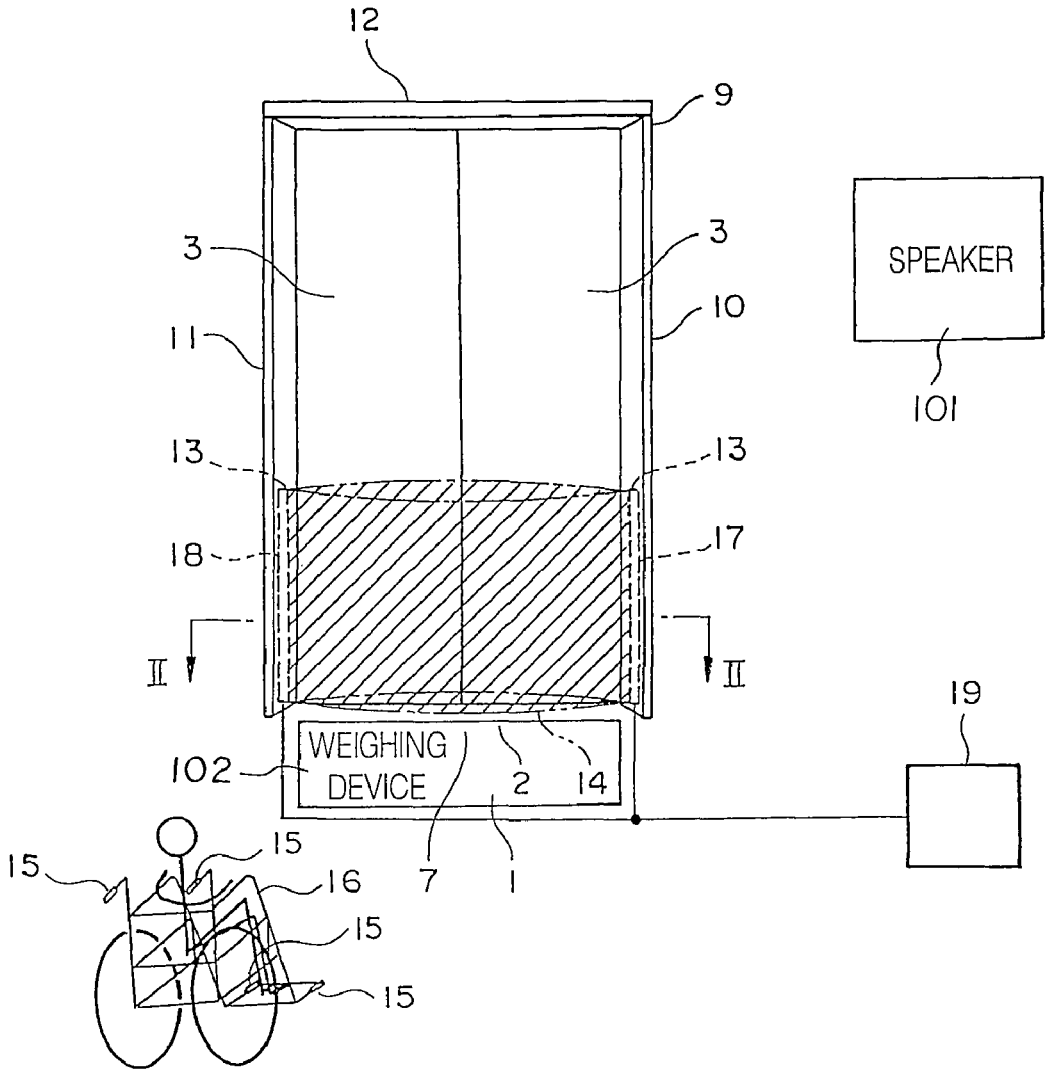
FIG. 1 is a schematic view of an elevator entrance apparatus according to Embodiment 1 of the present invention.
Figure 2:
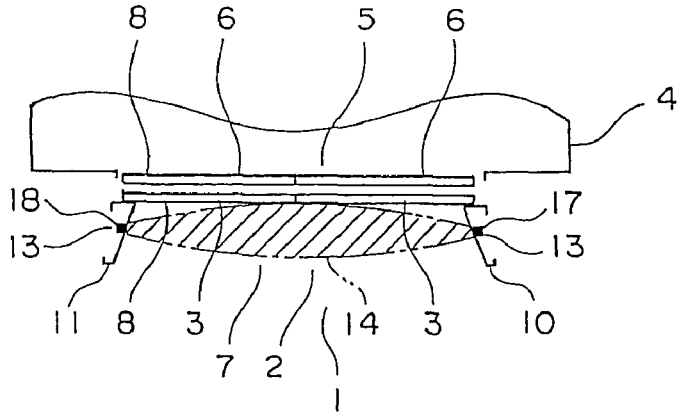
FIG. 2 is a sectional view taken along the line II-II of FIG. 1.

FIG. 1 is a schematic view of an elevator entrance apparatus according to Embodiment 1 of the present invention. FIG. 2 is a sectional view taken along the line II-II of FIG. 1. In each of the drawings, a landing entrance 2 is provided at a landing 1. The landing entrance 2 is opened and closed by a pair of landing doors 3. A car 4 is provided with a car entrance 5 (in FIG. 2). The car entrance 5 is opened and closed by a pair of car doors 6 (in FIG. 2). When the car 4 is positioned at any one of the floors, the landing doors 3 and the car doors 6 are engaged with each other by an engagement device (not shown) to be moved together.

An elevator entrance 7, which establishes communication between the landing 1 and the interior of the car 4 when the car 4 is positioned at anyone of the floors, includes the landing entrance 2 and the car entrance 5. Elevator doors 8 which open and close the elevator entrance 7 include the landing doors 3 and the car doors 6.

At the side portions and the top portion of the landing entrance 2, there is provided a jamb (entrance frame) 9 prepared by bending a metal plate. The jamb 9 is arranged outside of the doors 3 of each landing toward the landing 1 side. The jamb 9 has a pair of stiles 10 and 11 provided at the sides of the landing entrance 2 and a crosshead 12 provided horizontally between the top portions of the stiles 10 and 11.

One stile 10 and the other stile 11 are each provided with an ID tag reading device 13. The ID tag reading devices 13 each read transmission information from an ID tag 15 (transmission device) only when the ID tag 15 (i.e., transmission device) is within a predetermined detection range 14 which is provided to the inner side of the elevator entrance 7. In this example, the predetermined detection range 14 is set to be a range situated in the lower portion of the elevator entrance 7 and outside of the landing doors 3 toward the landing 1 side. ID tags 15 are respectively attached to a handle portion provided on the backrest of a wheelchair 16 for a physically handicapped person and on a footrest portion provided at the forward end of the wheelchair 16.

The ID tag reading devices 13 each read transmission information from the ID tags 15 when the wheelchair 16 existing at the landing 1 approaches the elevator entrance 7 and enters the predetermined detection range 14. The ID tag reading devices 13 each include a feeder device 17, which is a radio feeding portion for supplying, by means of radio waves, the ID tags 15 with the power for causing them to transmit transmission information, and a reception device 18, which is a reception portion for receiving the transmission information from the ID tags 15. The feeder device 17 is provided in the lower portion of one stile 10, and the reception device 18 is provided in the lower portion of the other stile 11.

The ID tags 15 receive radio waves from the feeder device 17 to generate electric power, and transmit radio waves containing transmission information by using the generated electric power as a driving power. The transmission information from the ID tags 15 is received by the reception device 18 only when the ID tags 15 are within the predetermined detection range 14.

Electrically connected to each of the ID tag reading devices 13 is a control device 19 for controlling the operation of the elevator. The control device 19 controls the operation of the elevator based on information as to whether transmission information has been read by the ID tag reading devices 13 or not. Each landing 1 is provided with a landing speaker 101, which serves as an announcing device, and the car 4 is provided with an in-car speaker (not shown), which serves as an announcing device. Further, the car 4 is provided with a weighing device 102 for detecting the presence of a passenger in the car 4. The landing speakers, the in-car speaker, and the weighing device are each electrically connected to the control device 19.

When the elevator entrance 7 is in the door-open state, and transmission information from the ID tags 15 is being read by the ID tag reading devices 13, the control device 19 controls the operation of the elevator so as to maintain the door-open state of the elevator entrance 7. Further, when the door-open state of the elevator entrance 7 is maintained throughout the reading of transmission information by the ID tag reading devices 13, the control device 19 causes the landing speaker and the in-car speaker to announce warning information calling for attention of the passengers. Further, when the transmission information from the ID tags 15 is read by the ID tag reading devices 13 during door closing operation of the elevator entrance 7, the control device 19 controls the operation of the elevator such that the door closing operation of the elevator entrance 7 is switched to a door opening operation.

Figure 3:
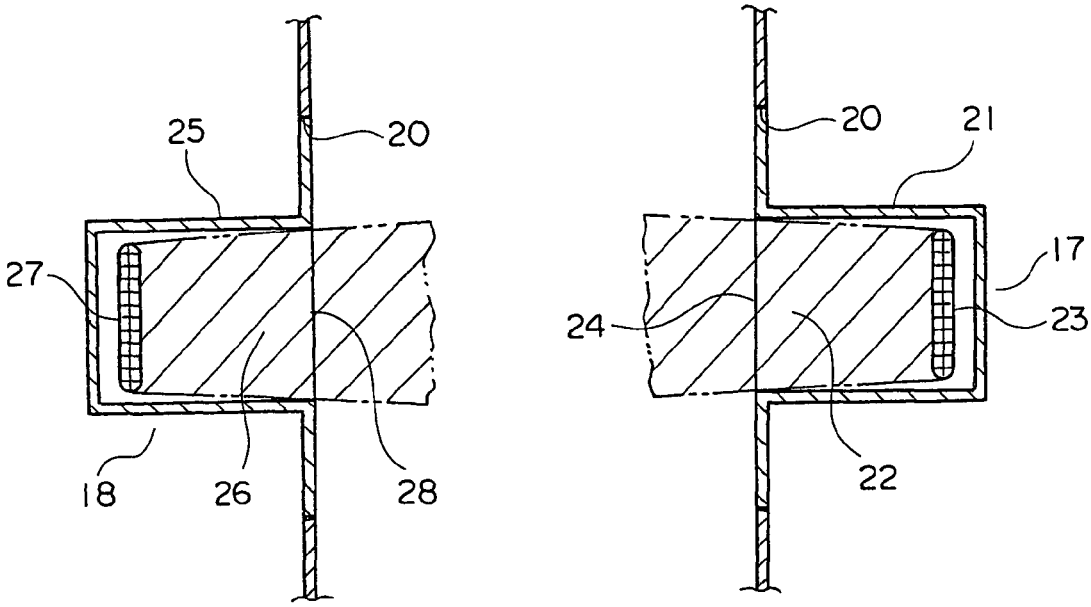
FIG. 3 is a sectional view of a feeder device and a reception device of FIG. 2.

Further, when transmission information from the ID tags 15 is being read by the ID tag reading devices 13 at a destination floor which has been subject to car call registration through operation of operation panels each provided in the car 4 and at each landing 1, and the presence of a passenger in the car 4 is being detected based on information from the weighing device, the control device 19 causes the landing speaker and the in-car speaker each provided to the destination floor to give (announce) warning information calling for attention of the passengers FIG. 3 is a sectional view of the feeder device 17 and the reception device 18 of FIG. 2. In the drawing, provided in the lower portion of each of one stile 10 and the other stile 11 is a cutout portion (reading device installment portion) 20 extending in the height direction of the elevator entrance 7.

In the cutout portion 20 provided in one stile 10, there is provided a feeder side casing 21 prepared by bending a metal plate which shields radio waves. The feeder side casing 21 is provided with an opening 22 that is open inwardly in the direction of the frontage of the elevator entrance 7. Further, the feeder side casing 21 accommodates a feeder antenna 23 for transmitting radio waves which supply the ID tags 15 with electric power. The feeder antenna 23 is electrically connected to the control device 19. The opening 22 is covered by a feeder side cover 24 formed of a material, such as plastic, rubber, or resin, which allow transmission of radio waves.

That is, of the radio waves transmitted from the feeder antenna 23, only those waves that have passed the opening 22 are transmitted to the outside of the feeder side casing 21. Due to this arrangement, the feeder side casing 21 restricts the range of the radio waves to be transmitted to the ID tags 15 from the feeder antenna 23. The feeder device 17 includes the feeder side casing 21 and the feeder antenna 23.

In the cutout portion 20 provided in the other stile 11, there is provided a reception side casing 25 prepared by bending a metal plate which shields radio waves. The reception side casing 25 is provided with an opening 26 that is open inwardly in the direction of the frontage of the elevator entrance 7. The reception side casing 25 accommodates a reception antenna 27 for receiving radio waves which contain transmission information from the ID tags 15. The reception antenna 27 is electrically connected to the control device 19. The opening 26 is covered by a reception side cover 28 formed of a material, such as plastic, rubber, or resin, which allow transmission of radio waves.

That is, of the radio waves from the ID tags 15, only those waves that have passed the opening 26 are received by the reception antenna 27. Due to this arrangement, the reception side casing 25 restricts the range of the radio waves to be received by the reception antenna 27 from the ID tags 15. The reception device 18 includes the reception side casing 25 and the reception antenna 27.

Figure 4:
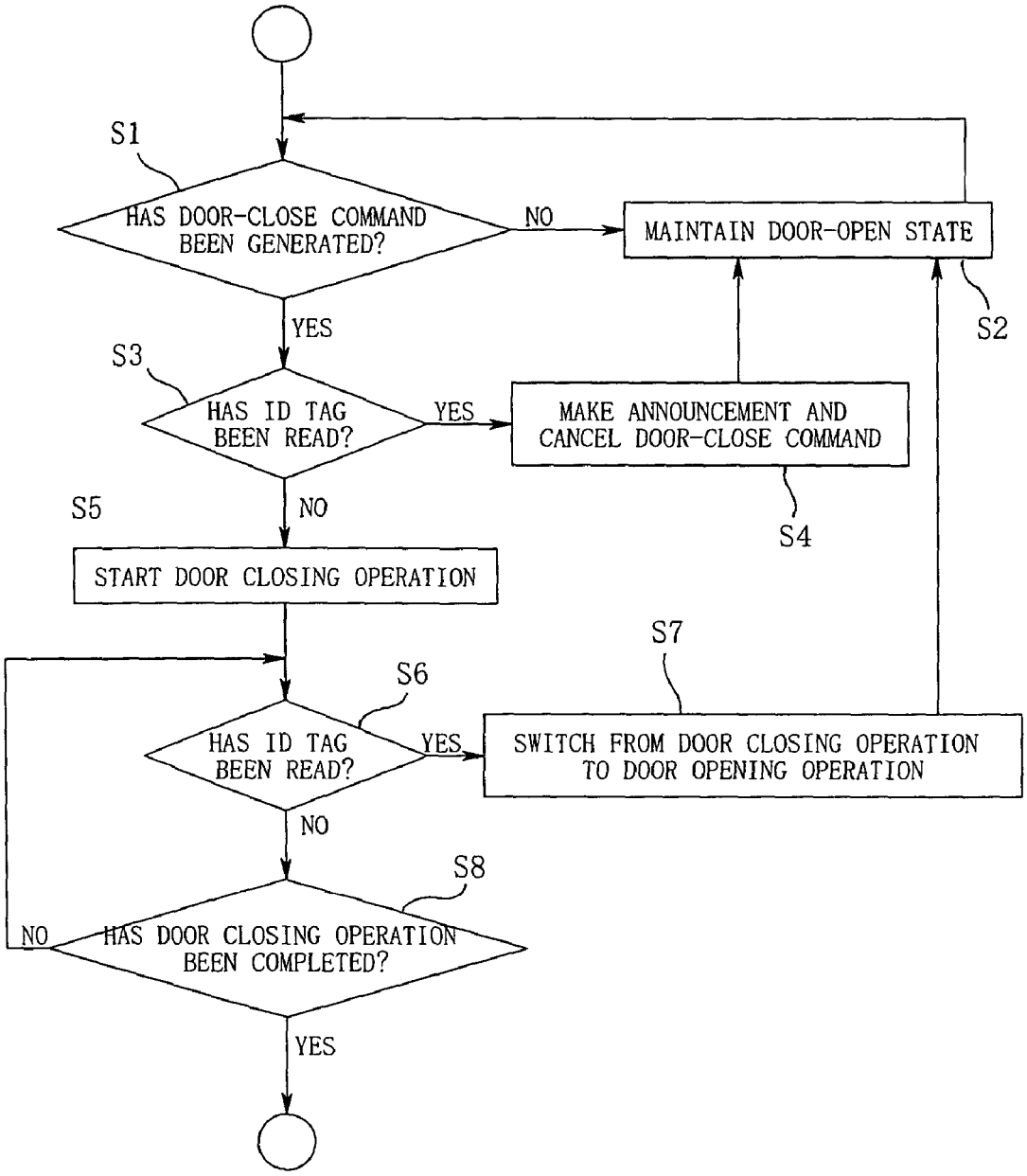
FIG. 4 is a flowchart showing operations of the elevator entrance apparatus of FIG. 1 from a door-open state to completion of a door closing operation.

Next, the operation of this embodiment will be described. FIG. 4 is a flowchart showing the operations of the elevator entrance apparatus of FIG. 1 from the door-open state to the completion of the closing of the doors. As shown in the drawing, when the elevator entrance 7 is in the door-open state, there is generated a door-close command in the control device 19 through operation of a door-close button (not shown) provided in the car 4 or after the elapse of a predetermined period of time since the placing of the elevator into the door-open state. After this, a judgment is made by the control device 19 as to whether a door-close command has been generated or not (S1). When no door-close command has been generated, the judgment as to whether a door-close command has been generated or not is repeatedly made by the control device 19 while maintaining the door-open state (S2).

When a door-close command is generated, a judgment is made by the control device 19 as to whether transmission information from the ID tags 15 has been read by the ID tag reading devices 13 or not (S3). When transmission information has been read, there is given, for example, an announcement to the effect that there is an obstacle at the elevator entrance 7 (warning information to call for attention of the passengers) from the landing speaker to the landing 1 through control of the control device 19, and the generation of a door-close command is canceled by the control device 19 (S4). After this, the door-open state is maintained until another door-close command is generated (S2).

In a case in which the reading of transmission information by the ID tag reading devices 13 is avoided, a door closing operation is started (S5). After this, during the door closing operation, a judgment is made again by the control device 19 as to whether transmission information from the ID tags 15 has been read by the ID tag reading devices 13 or not (S6).

When transmission information has been read, switching is effected from the door closing operation to a door opening operation, through control by the control device 19 (S7). When, after this, the door opening operation is completed, the door-open state of the elevator entrance 7 is maintained until another door-close command is generated (S2).

In the case in which the reading of transmission information by the ID tag reading devices 13 is avoided, a judgment is made by the control device 19 as to whether the door closing operation at the elevator entrance 7 has been completed or not (S8). When the door closing operation has not been completed, the door closing operation is continued, and a judgment is repeatedly made by the control device 19 as to whether transmission information has been read by the ID tag reading devices 13 or not. In the case in which the door closing operation has been completed, the processing for the opening/closing operation at the elevator entrance 7 is completed, and the procedure advances to the next operation.

Figure 5:
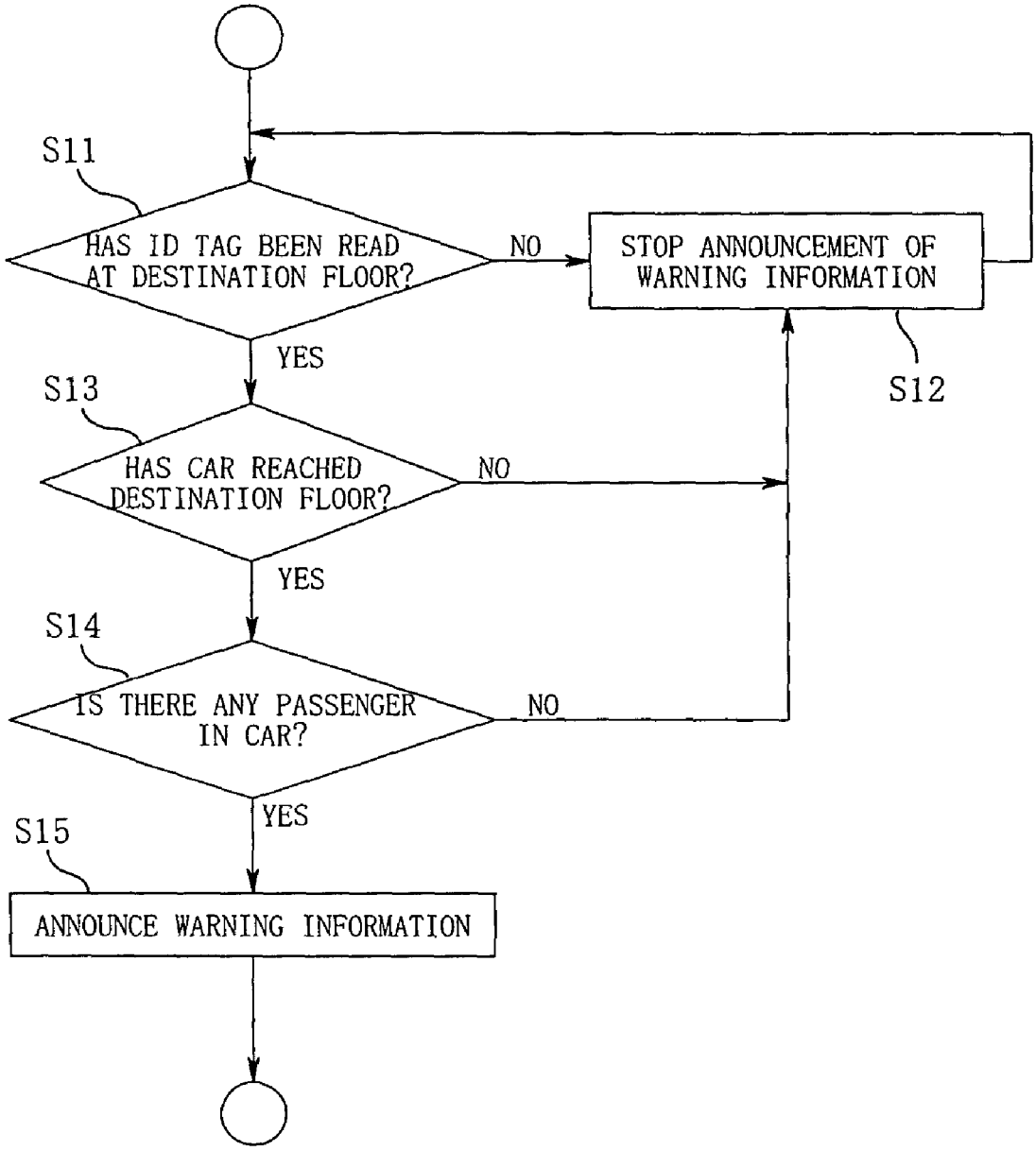
FIG. 5 is a flow chart showing processing operations of a control device of FIG. 1 when making a judgment as to whether warning information is to be announced or not

Next, a processing for making a judgment as to whether warning information is to be announced or not when the elevator entrance 7 is in the door-closed state will be described. FIG. 5 is a flowchart showing the processing operations of the control device 19 of FIG. 1 when the judgment as to whether warning information is to be announced or not is made. As shown in the drawing, when car call registration is effected through operation of a car operation panel (not shown) provided in the car 4, the car 4 is moved to the destination floor, which has been subject to car call registration. At this time, the control device 19 makes a judgment as to whether transmission information from the ID tags 15 has been read by the ID tag reading devices 13 installed at the elevator entrance 7 of the destination floor (S11). In the case in which the reading of transmission information from the ID tags 15 is avoided, the announcement of warning information is stopped, which stops warning information to be announced (S12), and the judgment as to whether transmission information at the destination floor has been read or not is repeatedly made by the control device 19.

In the case in which transmission information from the ID tags 15 has been read, a judgment is made by the control device 19 as to whether the car 4 has reached the destination floor or not (S13). When the car 4 has not reached the destination floor, the announcement of warning information is stopped (S12), and a judgment is repeatedly made by the control device 19 as to whether transmission information at the destination floor has been read or not.

When the car 4 has reached the destination floor, a judgment is made by the control device 19 as to whether a passenger exists in the car 4 or not, based on information from the weighing device (S14). When no passenger exists in the car 4, the announcement of warning information is stopped (S12), and a judgment is repeatedly made by the control device 19 as to whether transmission information at the destination floor has been read or not.

When a passenger exists in the car 4, warning information is announced from the landing speaker and the in-car speaker through control by the control device 19 (S15). In this example, the following announcement is made in the car 4: "Attention please. There is a passenger getting in", and the following announcement is made at the landing 1: "Attention please. There is a passenger in the car".

In this elevator entrance apparatus, the ID tag reading devices 13 read transmission information from the ID tags 15 only when the tags 15 exist within the predetermined detection range 14 provided on the inner side of the elevator entrance 7, and the control device 19 controls the operation of the elevator, based on information as to whether transmission information has been read by the ID tag reading devices 13 or not, so it is possible to detect more reliably a passenger at the elevator entrance 7, making it possible to prevent a malfunction during the opening/closing operation at the elevator entrance 7. For example, it is possible to prevent a passenger existing at a position spaced apart from the elevator entrance 7 from being erroneously detected, and to prevent failure to detect a passenger approaching the elevator entrance 7. Further, no expensive apparatuses, such as a camera and an image processing apparatus, are required, thereby making it possible to achieve a reduction in cost.

Further, the ID tag reading devices 13 each include the feeder device 17 for transmitting electric power for causing the ID tags 15 to transmit transmission information to the ID tags 15, and the reception device 18 for receiving transmission information from the ID tags 15, so it is possible to read transmission information from the ID tags 15 more reliably with a simple construction.

Further, the feeder antenna 23 is accommodated in the feeder side casing 21 which restricts the range of power supply to the ID tags 15, and the reception antenna 27 is accommodated in the reception side casing 25 which restricts the range of reception of transmission information from the ID tags 15, so the range in which transmission information is allowed to be read by the ID reading devices 13 can be easily set to be a predetermined detection range.

Further, the ID tag reading devices 13 are provided in the jamb 9, which makes it possible to reduce the space for providing the ID tag reading devices 13, and facilitates the operation of installing the ID tag reading devices 13.

Further, the jamb 9 is provided with the cutout portions 20, and the ID tag reading devices 13 are provided in the cutout portions 20, so it is possible to prevent the ID tag reading devices 13 from protruding from the surface of the jamb 9. Due to this arrangement, it is possible to prevent the wheelchair 16, etc. from coming into contact with the ID tag reading devices 13, making it possible to prevent the ID tag reading devices 13 from being damaged.

Further, when transmission information from the ID tags 15 is being read by the ID tag reading devices 13 while the elevator entrance 7 is in the door-open state, the control device 19 controls the operation of the elevator so as to maintain the door-open state of the elevator entrance 7, so it is possible to prevent the elevator doors 8 from coming into contact with a passenger.

Further, when transmission information from the ID tags 15 is read by the ID tag reading devices 13 during the door closing operation for the elevator entrance 7, the control device 19 controls the operation of the elevator such that the door closing operation for the elevator entrance 7 is switched to the door opening operation, so it is possible to prevent the elevator doors 8 from coming into contact with a passenger.

Further, when transmission information from the ID tags 15 is being read by the ID tag reading devices 13 at the destination floor, which has been subject to car call registration, and the presence of a passenger in the car 4 is being detected based on information from the weighing device, the control device 19 announces warning information for calling for attention of the passengers through the landing speaker of the destination floor and the in-car speaker, so it is possible to calling for attention of the passengers at the landing 1 and in the car 4.

While the feeder device 17 is provided in the lower portion of the stile 10 and the reception device 18 is provided in the lower portion of the stile 11 in the above example, it is also possible to provide the feeder device 17 over the entire region in the height direction of the stile 10 and to provide the reception device 18 over the entire region in the height direction of the stile 11.

Figure 6:
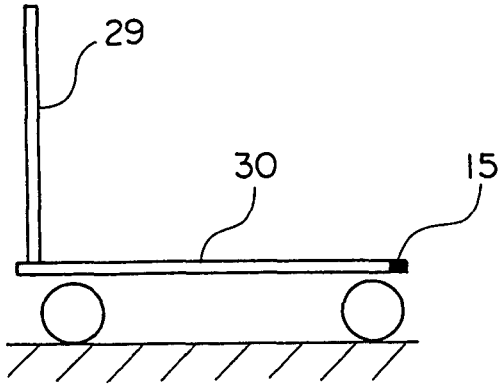
FIG. 6 is a side view of a handcart with an ID tag of FIG. 1 attached thereto.
Figure 7:
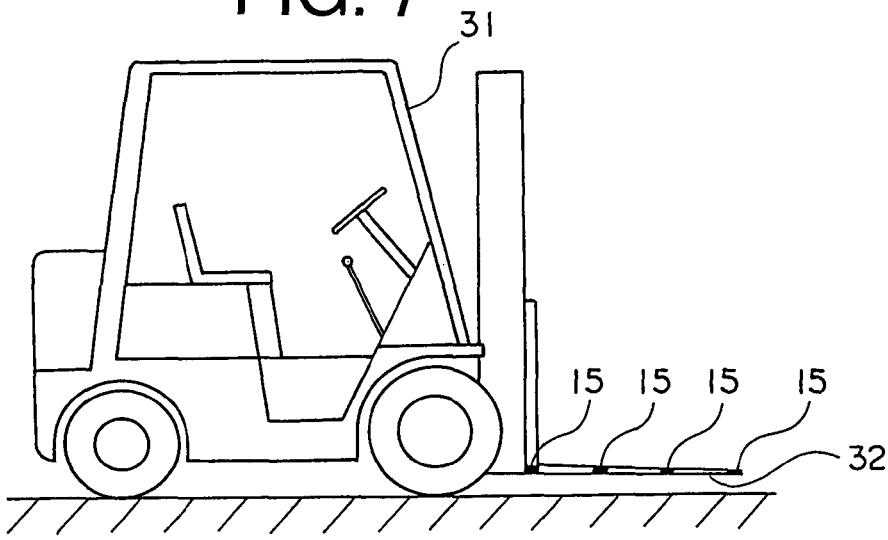
FIG. 7 is a side view of a forklift with the ID tags of FIG. 1 attached thereto.
Figure 8:
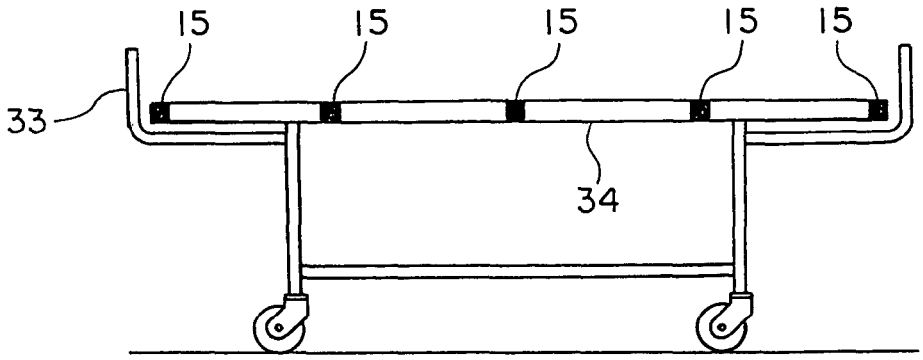
FIG. 8 is a side view of a stretcher with the ID tags of FIG. 1 attached thereto.

Further, while the ID tags 15 are attached to the wheelchair 16 in the above example, it is also possible to provide an ID tag 15 at the forward end of a loading platform 30 of a handcart 29 as shown in FIG. 6. Further, as shown in FIG. 7, it is also possible to provide a plurality of ID tags 15 in a fork portion (claw portion) 32 of a forklift 31. Further, it is also possible to provide a plurality of ID tags 15 in a transport rack 34 of a stretcher 33. For example, when a plurality of ID tags 15 are provided in the fork portion 32 or the transport rack 34, the ID tags are arranged at intervals in the advancing direction of the forklift 31 or the stretcher 33.

Embodiment 2

In the above example, it is only necessary to detect whether transmission information from the ID tags 15 has been read or not, and accordingly common transmission information is transmitted from the plurality of ID tags 15. However, it is also possible for the plurality of ID tags 15 to transmit different items of information so that each of the ID tags 15 is identified. That is, the transmission information transmitted from the ID tags 15 may be ID information (identifying information) for identifying the ID tags 15.

In this case, the operation of the elevator by the control device 19 can be switched between a specific operation mode which is set based on ID information and a normal operation mode which is previously set so as to perform normal operation. The operation of the elevator by the control device 19 is in the specific operation mode when ID information is being read, and is in the normal operation mode when no ID information is being read. Examples of the elevator operation in the specific operation mode include: making the duration of the door-open state longer than that in the normal operation mode; making the door-closing speed lower than that in the normal operation mode; and canceling car call registration from another landing 1. Otherwise, this embodiment is of the same construction as Embodiment 1.

Figure 9:
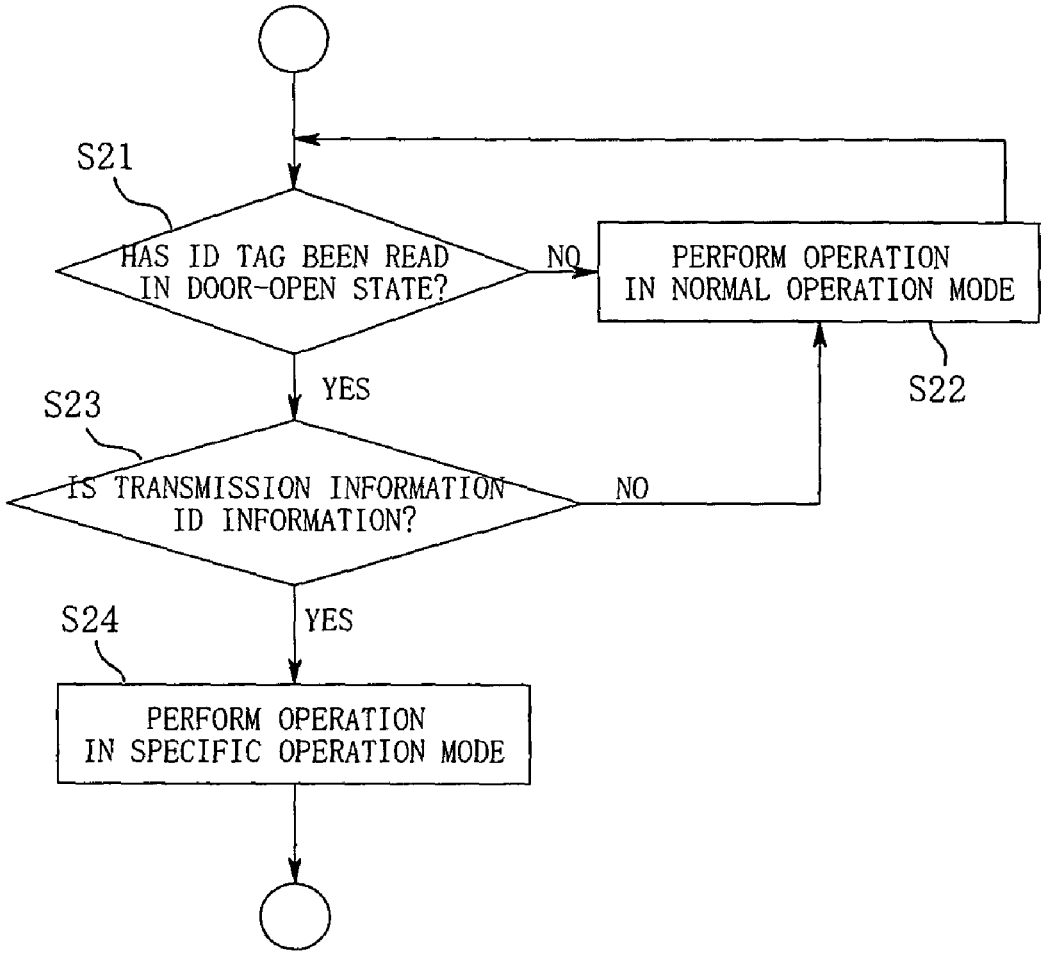
FIG. 9 is a flowchart showing processing operations when performing switching between a normal operation mode and a specific operation mode by a control device of an elevator entrance apparatus according to Embodiment 2 of the present invention.

Next, the processing of effecting switching between the normal operation mode and the specific operation mode will be illustrated. FIG. 9 is a flowchart showing the processing operations of effecting switching between the normal operation mode and the specific operation mode by the control device 19 of an elevator entrance apparatus according to Embodiment 2 of the present invention. As shown in the drawing, when the door opening operation at the elevator entrance 7 is completed, a judgment is made by the control device 19 as to whether transmission information from the ID tags 15 has been read, with the elevator entrance 7 being in the door-open state, by the ID tag reading devices 13 or not (S21). In the case in which the reading of transmission information is avoided, the elevator operation by the control device 19 is set to be in the normal operation mode (S22). After this, a judgment is made again by the control device 19 as to whether transmission information has been read or not.

When transmission information has been read, a judgment is made by the control device as to whether the transmission information is ID information or not (S23). When it is not ID information, the operation mode of the control device 19 is set to be in the normal operation mode (S22). After this, a judgment is made again by the control device 19 as to whether transmission information has been read or not.

When the transmission information is ID information, the operation of the elevator by the control device 19 is set to be in the specific operation mode set based on the ID information (S24).

In this elevator entrance apparatus, the operation of the elevator by the control device 19 can be switched between the normal operation mode and the specific operation mode set based on ID information; when the reading of ID information is avoided, the operation is set to be in the normal operation mode; and when ID information is being read, the operation is in the specific operation mode, so the operation of the elevator can be performed according to the ID information. Due to this arrangement, it is possible, for example, to identify a passenger who takes time in getting on and off the car 4, such as a wheelchair user, or a forklift user, making it possible, for example, to elongate the duration of the door-open state of the elevator entrance 7 or to lower the door closing speed for such a passenger.

Embodiment 3

Figure 10:
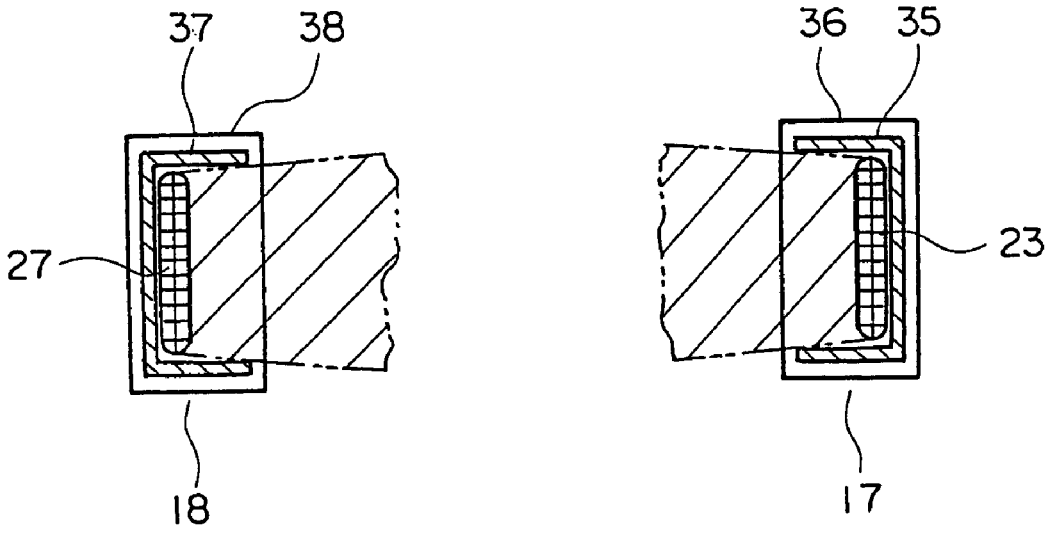
FIG. 10 is a plan sectional view of an ID tag reading device of an elevator entrance apparatus according to Embodiment 3 of the present invention.

FIG. 10 is a plan sectional view of the ID tag reading devices of an elevator entrance apparatus according to Embodiment 3 of the present invention. In the drawing, the feeder device 17 includes the feeder antenna 23, a feeder side casing 35 accommodating the feeder antenna 23, and a protection member 36 covering the feeder antenna 23 and the feeder side casing 35. The reception device 18 includes the reception antenna 27, a reception side casing 37 accommodating the feeder antenna 27, and a protection member 38 covering the reception antenna 27 and the reception side casing 37.

The feeder antenna 23 and the feeder side casing 35 are embedded in the protection member 36 and fixed by the protection member 36. The protection member 36 is formed of a material, such as plastic, rubber, or resin, which allow transmission of radio waves. The feeder side casing 35 is prepared by bending a metal plate shielding radio waves. Further, the feeder side casing 35 is provided with an opening. Of the radio waves transmitted from the feeder antenna 23, only those radio waves that pass the opening are transmitted to the exterior of the feeder side casing 35. That is, the range of the radio waves transmitted from the feeder antenna 23 to the ID tags 15 is restricted by the feeder side casing 35.

The reception antenna 27 and the reception side casing 37 are embedded in the protection member 38 and fixed by the protection member 38. The protection member 38 is formed of a material, such as plastic, rubber, or resin, which allow transmission of radio waves. The reception side casing 37 is provided with an opening. Of the radio waves transmitted from the feeder ID tags 15, only those radio waves that pass the opening are received by the reception antenna 27. That is, the range of the radio waves containing transmission information from the ID tags 15 and received by the reception antenna 27 is restricted by the reception side casing 37. Otherwise, this embodiment is of the same construction as Embodiment 1.

In this way, the feeder antenna 23 and the feeder side casing 35 are embedded in the protection member 36 and fixed by the protection member 36, and the reception antenna 27 and the reception side casing 37 are embedded in the protection member 38 and fixed by the protection member 38, so it is possible to prevent the feeder device 17 and the reception device 18 from being damaged by, for example, coming into contact with a passenger. Further, it is possible to prevent deviation of the feeder antenna 23 with respect to the feeder side casing 35, and deviation of the reception antenna 27 with respect to the reception side casing 37, making it possible to set, in a more stable manner, the predetermined detection range for reading the ID tags 15.

Embodiment 4

Figure 11:
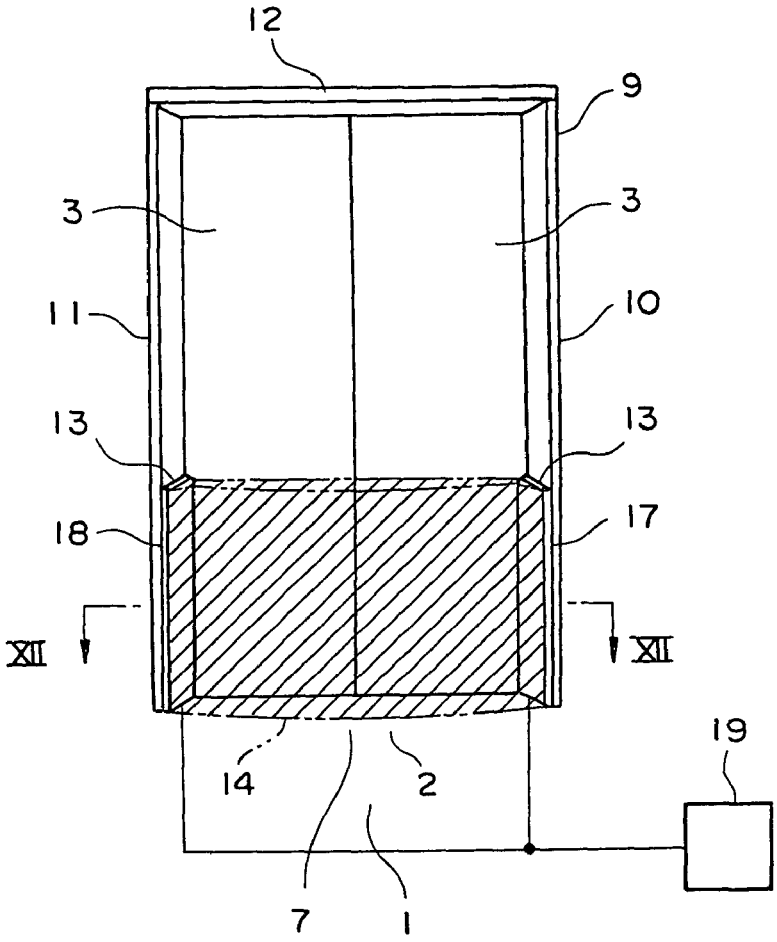
FIG. 11 is a schematic view of an elevator entrance apparatus according to Embodiment 4 of the present invention.
Figure 12:
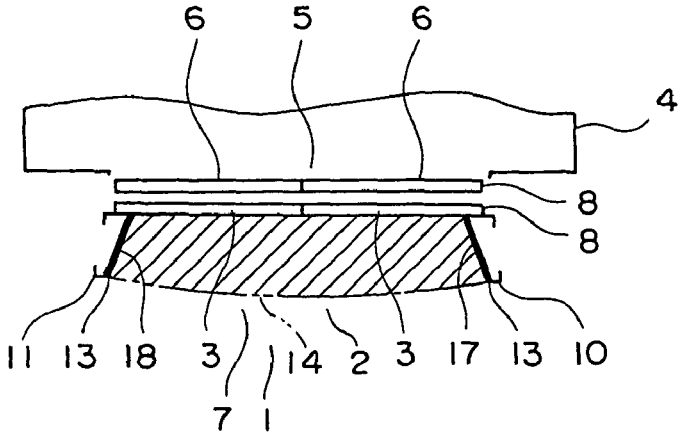
FIG. 12 is a sectional view taken along the line XII-XII of FIG. 11.

FIG. 11 is a schematic view of an elevator entrance apparatus according to Embodiment 4 of the present invention. FIG. 12 is a sectional view taken along the line XII-XII of FIG. 11. In the drawings, on the surface of the lower portion of one stile 10 extending along a side portion of the elevator entrance 7, there is provided the feeder device 17, which is similar to that of Embodiment 3. On the surface of the lower portion of the other stile 11 extending along a side portion of the elevator entrance 7, there is provided the reception device 18, which is similar to that of Embodiment 3. The respective configurations of the feeder device 17 and the reception device 18 are plate-like ones extending along the surfaces of the stiles 10 and 11. Otherwise, this embodiment is of the same construction as Embodiment 1.

In such the elevator entrance apparatus, the feeder device 17 and the reception device 18 are provided on the surfaces of the stiles 10 and 11 extending along the side portions of the elevator entrance 7, so the mounting of the feeder device 17 and the reception device 18 to the stiles 10 and 11 is facilitated. Further, it is possible to protect the stiles 10 and 11 by the feeder device 17 and the reception device 18 fixed by the protection members 36 and 38, making it possible to prevent the stiles 10 and 11 from being flawed by, for example, a wheelchair coming into contact therewith.

Embodiment 5

Figure 13:
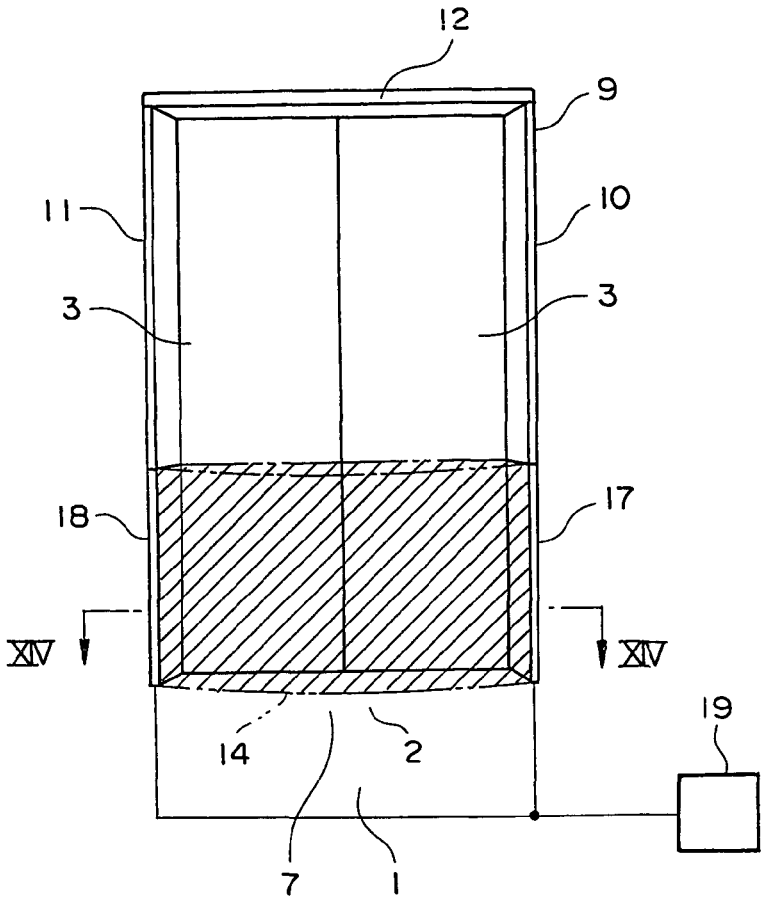
FIG. 13 is a schematic view of an elevator entrance apparatus according to Embodiment 5 of the present invention.
Figure 14:
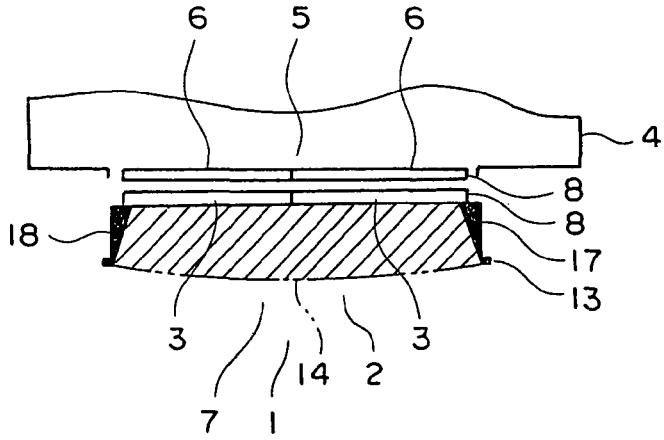
FIG. 14 is a sectional view taken along the line XIV-XIV of FIG. 13.

FIG. 13 is a schematic view of an elevator entrance apparatus according to Embodiment 5 of the present invention. FIG. 13 is a sectional view taken along the line XIV-XIV of FIG. 13. In the drawings, the lower portion of one stile 10 is formed as the feeder device 17, which is similar to that of Embodiment 3. The lower portion of the other stile 11 is formed as the reception device 18, which is similar to that of Embodiment 3. The landing side exposed surface of the feeder device 17 is continuous with the landing 1 side exposed surface of the stile 10. The landing 1 side exposed surface of the reception device 18 is continuous with the landing 1 side exposed surface of the stile 11. Otherwise, this embodiment is of the same construction as Embodiment 1.

In such the elevator entrance apparatus, the lower portion of the stile 10 is formed as the feeder device 17, and the lower portion of the stile 11 is formed as the reception device 18, so it is possible to eliminate a step between the feeder device 17 and the stile 10 and a step between the reception device 18 and the stile 11, making it possible to prevent a deterioration in design of the jamb 9.

Embodiment 6

Figure 15:
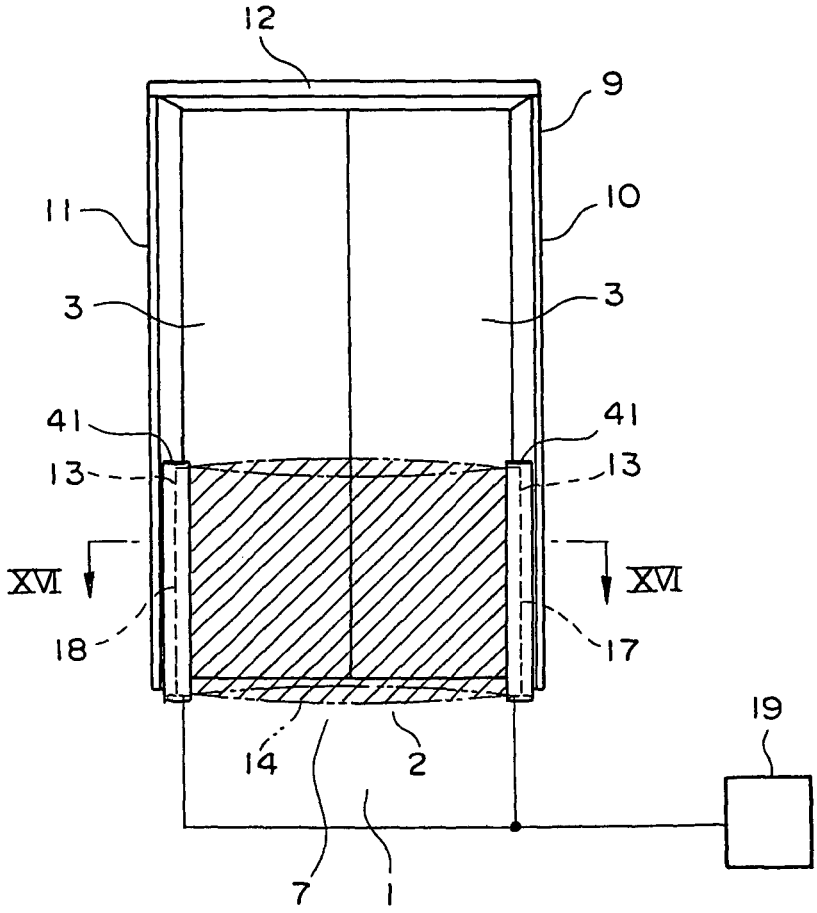
FIG. 15 is a schematic view of an elevator entrance apparatus according to Embodiment 6 of the present invention.
Figure 16:
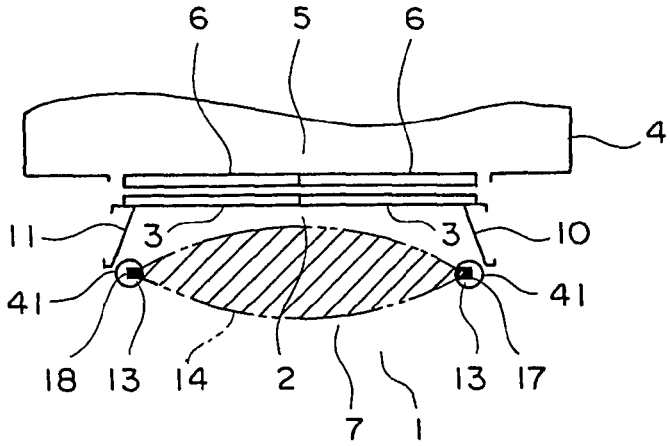
FIG. 16 is a sectional along the line XVI-XVI of FIG. 15.

FIG. 15 is a schematic view of an elevator entrance apparatus according to Embodiment 6 of the present invention. FIG. 16 is a sectional view taken along the line XVI-XVI of FIG. 15. In the drawings, on the side portions of the elevator, there are provided a pair of guard members 41. The guard members 41 are bar-like members extending in the height direction of the elevator entrance 7. The guard members 41 are arranged outside of the stiles 10 and 11, toward the landing 1 side and are arranged between the stiles 10 and 11.

The guard members 41 are provided with cutout portions opposed to each other. Within the cutout portion of one guard member 41, there is provided the feeder device 17, which is similar to that of Embodiment 1. Within the cutout portion of the other guard member 41, there is provided the reception device 18, which is similar to that of Embodiment 1. A predetermined detection range is set by the feeder device 17 and the reception device 18 provided in the guard members 41. Otherwise, this embodiment is of the same construction as Embodiment 1.

In such the elevator entrance apparatus, the feeder device 17 and the reception device 18 are provided in the guard members 41 provided at the side portions of the elevator entrance 7, so it is possible to protect the stiles 10 and 11 by the guard members 41, making it possible, for example, to prevent the stiles 10 and 11 from being flawed by a wheelchair or the like coming into contact therewith.

Embodiment 7

Figure 17:
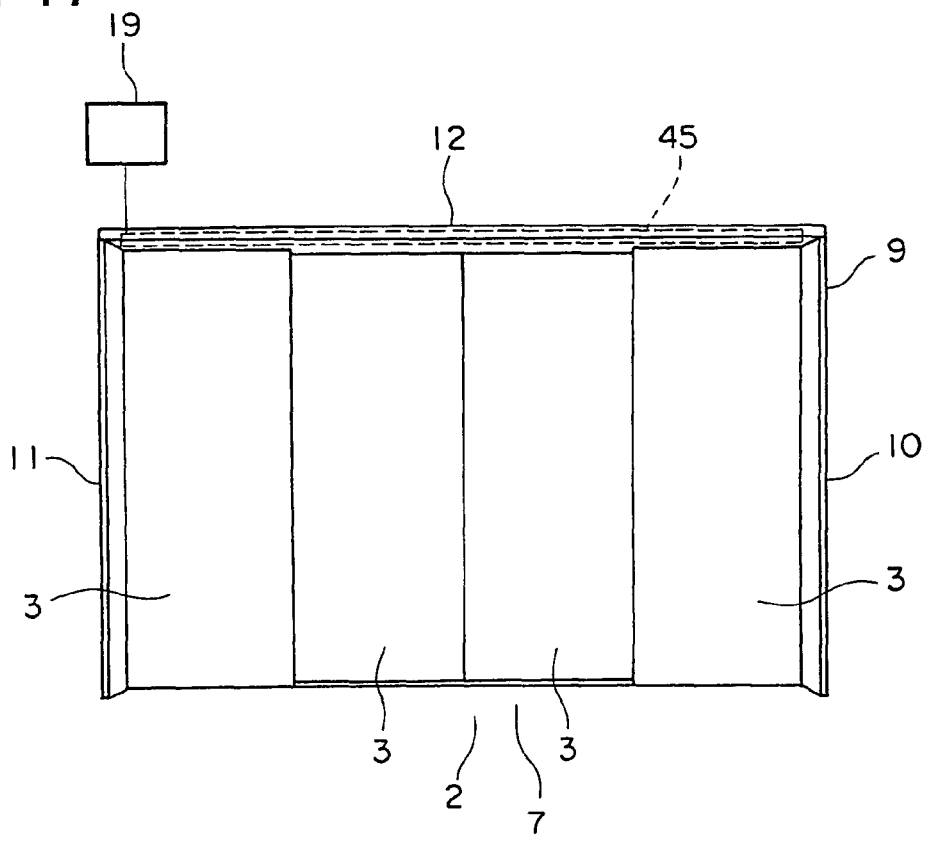
FIG. 17 is a schematic view of an elevator entrance apparatus according to Embodiment 7 of the present invention.

FIG. 17 is a schematic view of an elevator entrance apparatus according to Embodiment 7 of the present invention. In the drawing, an ID tag reading device 45 is formed by integrating with each other a feeder device for supplying the ID tags 15 with power, and a reception device for receiving transmission information from the ID tags 15. The ID tag reading device 45 is not provided in the stiles 10 and 11 but solely in the crosshead 12. Further, the ID tag reading device 45 is arranged over the entire region extending in the frontage width direction of the elevator entrance 7. The predetermined detection range where transmission information from the ID tags 15 is read by the ID tag reading device 45 is the entire range on the inner side of the elevator entrance 7. Otherwise, this embodiment is of the same construction as Embodiment 1.

In such the elevator entrance apparatus, the feeder device and the reception device are integrated with each other, so it is possible to reduce the number of mounting positions for the ID tag reading device 45, and to achieve a reduction in time and effort in the operation of mounting the ID tag reading device 45 to the jamb 9. Further, since the ID tag reading device 45 is provided solely in the crosshead 12, it is possible, for example, to prevent the ID tag reading device 45 being damaged by a wheelchair or the like coming into contact therewith.

While the ID tag reading device 45 is provided in the crosshead 12 in the above example, it is also possible to provide the ID tag reading device 45 in one of the stiles 10 and 11. This also helps to achieve a reduction in time and effort in the operation of mounting the ID tag reading device 45.

Embodiment 8

Figure 18:
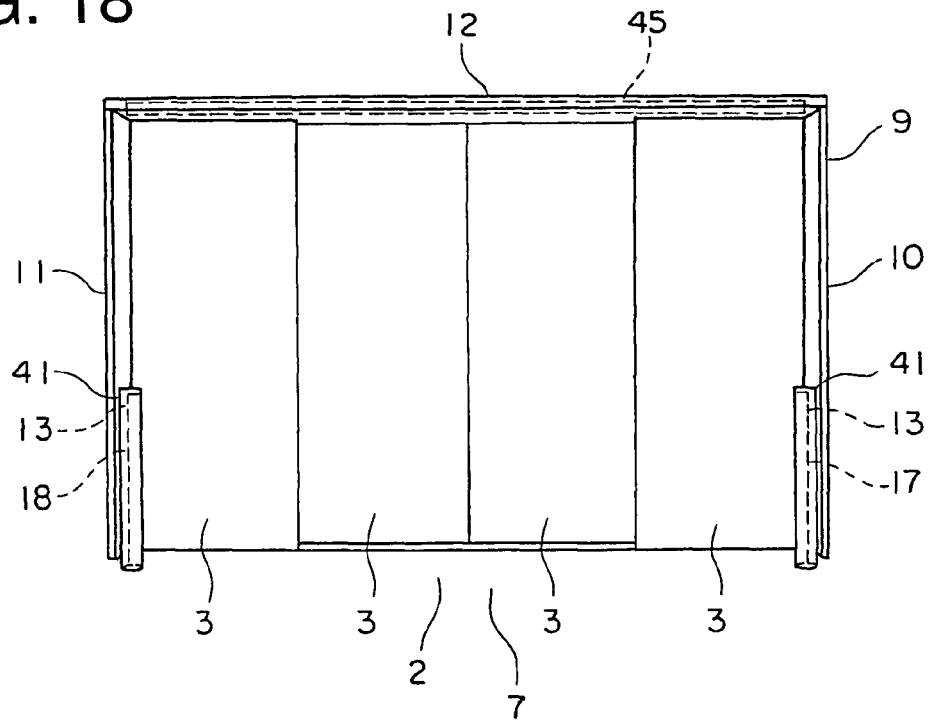
FIG. 18 is a schematic view of an elevator entrance apparatus according to Embodiment 8 of the present invention.

FIG. 18 is a schematic view of an elevator entrance apparatus according to Embodiment 8 of the present invention. In the drawing, in the crosshead 12, there is provided the ID tag reading device 45, which is similar to that of Embodiment 7. On the side portions of the elevator entrance 7, there are provided the pair of guard members 41, which are similar to those of Embodiment 6. Each guard member 41 is provided with the ID tag reading device 13, which is similar to that of Embodiment 6. That is, the construction of Embodiment 8 is a combination of the constructions of Embodiment 6 and Embodiment 7.

In such the elevator entrance apparatus, the ID tag reading device 45 is provided in the crosshead 12, and the ID tag reading devices 13 are provided in the pair of guard members 41 provided on the side portions of the elevator entrance 7, so even when the elevator entrance 7 is wide, the ID tag reading devices 13 and 45 can complement each other in terms of the range in which transmission information from the ID tags 15 is read, making it possible to set the predetermined detection range.

While the ID tag reading devices 13 are provided in the guard members 41 in the above example, it is also possible to provide them on the stiles 10 and 11.

While the above embodiments adopt an radio wave system in which the power supply to the ID tags 15 and the output of transmission information from the ID tags are effected by means of radio waves, it is also possible to adopt a magnetic system in which they are effected by magnetism, or an acoustomagnetic system in which they are effected by acoustomagnetism.

The invention claimed is:

1. An elevator entrance apparatus, comprising:

a reading device for reading transmission information from a transmission device only when the transmission device is within a predetermined detection range which is within an elevator entrance, wherein boundaries of the predetermined detection range are defined by sides of the elevator entrance which face each other; and a control device for controlling an operation of an elevator based on information as to whether the transmission information has been read by the reading device or not, wherein:

the elevator entrance has a guard member provided on a side portion thereof; and the reading device is provided within the guard member.

2. The elevator entrance apparatus according to claim 1, wherein the reading device includes:

a radio feeder portion for supplying the transmission device with power for transmitting the transmission information; and a reception portion for receiving the transmission information from the transmission device.

3. The elevator entrance apparatus according to claim 2, wherein:

the radio feeder portion includes: a feeder antenna for transmitting radio waves for supplying power to the transmission device; and a feeder side casing accommodating the feeder antenna and restricting a range of the radio waves transmitted from the feeder antenna;

the reception portion includes a reception antenna receiving the transmission information from the transmission device, and a reception side casing accommodating reception antenna and restricting a range of the transmission information from the transmission device received by the reception antenna; and the transmission information is read by the reading device only in a range which is restricted to the predetermined detection range by the feeder side casing and the reception side casing.

4. The elevator entrance apparatus according to claim 1, wherein when the elevator entrance is in a door-open state and the transmission information is being read by the reading device, the control device controls the operation of the elevator so as to maintain the door-open state of the elevator entrance.

5. The elevator entrance apparatus according to claim 1, wherein when the transmission information is read by the reading device during a door closing operation of the elevator entrance, the control device controls the operation of the elevator such that the door closing operation of the elevator entrance is switched to a door opening operation.

6. The elevator entrance apparatus according to claim 1, wherein:

the elevator entrance apparatus further comprises an announcing device provided in at least one of a landing and a car;

the car is provided with a weighing device for detecting a presence of a passenger in the car; and when the transmission information is read by the reading device at a destination floor subject to car call registration, and the presence of a passenger is detected based on information from the weighing device, the control device announces warning information for calling for attention of the passenger through the announcing device.

7. The elevator entrance apparatus according to claim 1, wherein:

the transmission information is ID information for identifying the transmission device; and the operation of the elevator by the control device can be switched between a specific operation mode set based on the ID information and a normal operation mode set for a normal operation in advance, the operation being the specific operation mode when the ID information is being read by the reading device and the normal operation mode when reading of the ID information by the reading device is avoided.

8. The elevator entrance apparatus according to claim 1, wherein:

the reading device reads the transmission information from the transmission device only when the transmission device is located at a height which is at a lower portion of the elevator entrance.

9. The elevator entrance apparatus according to claim 8, wherein:

the reading device reads the transmission information only when the transmission device is within the elevator entrance between the sides of the elevator entrance which face each other.

10. An elevator entrance apparatus, comprising:

a reading device for reading transmission information from a transmission device only when the transmission device is within a predetermined detection range which is within an elevator entrance, wherein boundaries of the predetermined detection range are defined by sides of the elevator entrance which face each other; and a control device for controlling an operation of an elevator based on information as to whether the transmission information has been read by the reading device or not, wherein the reading device is provided in an entrance frame surrounding the elevator entrance.

11. The elevator entrance apparatus according to claim 10, wherein:

the elevator entrance includes the entrance frame which includes a cutout portion; and the reading device is provided in the cutout portion.

12. The elevator entrance apparatus according to claim 10, wherein the reading device includes:

a radio feeder portion for supplying the transmission device with power for transmitting the transmission information; and a reception portion for receiving the transmission information from the transmission device.

13. The elevator entrance apparatus according to claim 12, wherein:

the radio feeder portion includes: a feeder antenna for transmitting radio waves for supplying power to the transmission device; and a feeder side casing accommodating the feeder antenna and restricting a range of the radio waves transmitted from the feeder antenna;

the reception portion includes a reception antenna receiving the transmission information from the transmission device, and a reception side casing accommodating reception antenna and restricting a range of the transmission information from the transmission device received by the reception antenna; and the transmission information is read by the reading device only in a range which is restricted to the predetermined detection range by the feeder side casing and the reception side casing.

14. The elevator entrance apparatus according to claim 10, wherein when the elevator entrance is in a door-open state and the transmission information is being read by the reading device, the control device controls the operation of the elevator so as to maintain the door-open state of the elevator entrance.

15. The elevator entrance apparatus according to claim 10, wherein when the transmission information is read by the reading device during a door closing operation of the elevator entrance, the control device controls the operation of the elevator such that the door closing operation of the elevator entrance is switched to a door opening operation.

16. The elevator entrance apparatus according to claim 10, wherein:

the elevator entrance apparatus further comprises an announcing device provided in at least one of a landing and a car;

the car is provided with a weighing device for detecting a presence of a passenger in the car; and when the transmission information is read by the reading device at a destination floor subject to car call registration, and the presence of a passenger is detected based on information from the weighing device, the control device announces warning information for calling for attention of the passenger through the announcing device.

17. The elevator entrance apparatus according to claim 10, wherein:

the transmission information is ID information for identifying the transmission device; and the operation of the elevator by the control device can be switched between a specific operation mode set based on the ID information and a normal operation mode set for a normal operation in advance, the operation being the specific operation mode when the ID information is being read by the reading device and the normal operation mode when reading of the ID information by the reading device is avoided.

18. The elevator entrance apparatus according to claim 10, wherein:

the reading device reads the transmission information from the transmission device only when the transmission device is located at a height which is at a lower portion of the elevator entrance.

19. The elevator entrance apparatus according to claim 10, wherein:

the reading device reads the transmission information only when the transmission device is within the elevator entrance between the sides of the elevator entrance which face each other.

* * * * *